US010286931B2

(12) United States Patent
Sanchez et al.

(10) Patent No.: US 10,286,931 B2
(45) Date of Patent: May 14, 2019

(54) BOGIE FOR FULL DOUBLE DECK EMU

(71) Applicant: ALSTOM TRANSPORT TECHNOLOGIES, Saint-Ouen (FR)

(72) Inventors: Carlos Sanchez, Paris (FR); Alain Rodet, Chalon sur Saone (FR); Jose Julio Muyo, Paris (FR); Emmanuel Lafoix, Courbevoie (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 263 days.

(21) Appl. No.: 15/332,153

(22) Filed: Oct. 24, 2016

(65) Prior Publication Data

US 2017/0113706 A1 Apr. 27, 2017

(30) Foreign Application Priority Data

Oct. 23, 2015 (FR) ..... 15 60142
Jan. 18, 2016 (FR) ..... 16 50360

(51) Int. Cl.
*B61D 1/06* (2006.01)
*B61F 3/12* (2006.01)
(Continued)

(52) U.S. Cl.
CPC ..... *B61F 3/125* (2013.01); *B61D 1/06* (2013.01); *B61F 5/52* (2013.01); *B61F 3/16* (2013.01)

(58) Field of Classification Search
CPC ..... B61F 3/00; B61F 3/02; B61F 3/04; B61F 3/08; B61F 3/12; B61F 3/125; B61F 3/16
See application file for complete search history.

(56) References Cited

U.S. PATENT DOCUMENTS 3,570,408 A * 3/1971 Lich ..... B61F 3/04 105/133
3,774,549 A * 11/1973 Lich ..... B61F 5/144 105/182.1
(Continued)

FOREIGN PATENT DOCUMENTS

DE 29512446 10/1995
EP 0616935 9/1994
(Continued)

OTHER PUBLICATIONS

French Search Report dated Aug. 22, 2016; Application No. FR 1650360.
(Continued)

*Primary Examiner* — Jason C Smith
(74) *Attorney, Agent, or Firm* — Young & Thompson

(57) ABSTRACT

A railway vehicle includes two adjacent carriages (6), each including a carriage body (8), each carriage (6) including a lower floor (54) and an upper floor (56), positioned above each other so as to define a lower level (58) and an upper level (60), the bodies (8) being supported by a common bogie (1) and being articulated with each other through an articulation device (2). The carriages (6) are connected to each other through an interconnection passage (62), the passage (62) extending substantially at right angles to the articulation device (2) and including a lower floor connecting the lower floors (54) of both carriages (6) and an upper floor connecting the upper floors (56) of both carriages.

20 Claims, 6 Drawing Sheets

(51) Int. Cl.
*B61F 3/16* (2006.01)
*B61F 5/52* (2006.01)

(56) References Cited

U.S. PATENT DOCUMENTS 3,774,550 A * 11/1973 Lich ..... B61F 5/16 105/182.1
5,546,868 A * 8/1996 Sugimoto ..... B61F 7/00 105/178
5,615,786 A * 4/1997 Hoyon ..... B61D 3/10 105/3
6,601,520 B2 * 8/2003 Eche ..... B61C 9/52 105/133
8,011,305 B2 * 9/2011 Al-Kaabi ..... B61D 3/10 105/3
8,794,160 B2 * 8/2014 Nishimura ..... B61D 13/00 105/158.2
9,694,831 B2 * 7/2017 Kreuzweger ..... B61F 5/02
2017/0113705 A1 * 4/2017 Sanchez ..... B61D 1/06
2017/0113706 A1 * 4/2017 Sanchez ..... B61F 3/125
2018/0099682 A1 * 4/2018 Kondyra ..... B61D 1/00

FOREIGN PATENT DOCUMENTS

EP 0642964 3/1995
EP 0831003 3/1998
EP 0831003 A2 * 3/1998 ..... B61F 3/125
EP 1270359 1/2003
EP 1312526 5/2003
EP 1312526 A1 * 5/2003 ..... B61D 1/06
WO 03084794 10/2003

OTHER PUBLICATIONS

French Search Report dated Jul. 11, 2016; Application No. FR 1560142.
European Search Report dated Mar. 17, 2017 in corresponding European Patent Application No. 16195129.8.

* cited by examiner

BOGIE FOR FULL DOUBLE DECK EMU

BACKGROUND OF THE INVENTION

Field of the Invention

The present invention relates to a railway vehicle of the type comprising at least two adjacent carriages, each comprising a carriage body, each carriage comprising a lower floor and an upper floor, positioned above each other so as to define a lower level and an upper level, said bodies being supported by a common bogie and being articulated with each other by an articulation device attached to both bodies so as to form an articulated connection between both bodies.

The invention more particularly applies to railway vehicles with two stories intended for paths between several cities, of the type of high speed trains, interregional trains and other trains.

Description of the Related Art

In this type of railway vehicles, the interconnection between the successive carriages is generally accomplished on a single level, i.e. the passengers have to climb to the upper level or come down from the upper level in order to pass from one carriage to the next, which complicates the circulation in the railway vehicle and poses problems for persons with reduced mobility.

For example in document EP-1 312 526, railway vehicles were proposed wherein a passage between two successive carriages is accomplished on two levels. However, in this document, the interconnection passes between two wheels directly connected to the body of the railway vehicle and not upright to a bogie supporting the ends of two successive bodies and allowing the driving of the railway vehicle. In this document, when such a bogie is provided, for the end carriages, the floor is raised so as to pass above the bogie, the vehicle only comprising a single level upright to the bogie.

The interconnection described in document EP-1 312 526 is therefore not satisfactory for railway vehicles rolling at a high speed in which the ends of two successive carriages are supported by a bogie. Further, the railway vehicle is not optimized in terms of capability of receiving travelers.

SUMMARY OF THE INVENTION

One of the objects of the invention is to overcome these drawbacks by proposing a railway vehicle for which two successive carriages are supported by a common bogie while allowing a two-level connection without raising the floor.

For this purpose, the invention relates to a railway vehicle of the aforementioned type, wherein the carriages are connected to each other through an interconnection passage, said passage extending substantially upright to the articulation device and comprising a lower floor connecting the lower floors of both carriages and an upper floor connecting the upper floors of both carriages.

Providing an interconnection passage with two levels gives the possibility to the passengers of an upper or lower story of a carriage of passing from the upper or lower storey of another carriage without changing story. Thus, the circulation in the railway vehicle may be accomplished without passing through steps or ramps, which simplifies the displacement, notably for passengers with reduced mobility.

According to other features of the railway vehicle according to the invention, taken individually or according to all the technically possible combinations:

the lower floors of the carriages and of the interconnection passage substantially extend at the same height and the upper floors of the carriages and of the interconnection passage substantially extend at the same height, greater than the height of the lower floors;

the plane of the lower floors coincides with a plane crossing the bogie;

the lower floor of the carriages extends at a height substantially comprised between 530 and 550 mm and the upper floor of the carriages extends at a height substantially comprised between 2 380 and 2 400 mm;

the bogie comprises a chassis resting on four wheels, one pair of wheels extending on each side of the chassis, said chassis supporting at least one motor positioned on one side of the chassis and connected to at least one wheel through transmission means, each wheel including an individual wheel shaft;

the bogie comprises two motors each positioned on one of the sides of the chassis on either side of the space along a transverse direction substantially perpendicular to the longitudinal direction, each motor being connected to two of the wheels of the bogie through transmission means;

the bogie is without any elements positioned between the longitudinal members above a plane defined by the crossmembers, the bogie thus defining a volume left free for passing from the lower floor to the interconnection passage;

the articulation device is received in a space of the bogie, said space being delimited according to a longitudinal direction with a first abutment surface and a second abutment surface extending on either side of said space, the articulation device extending facing first and second abutment surfaces so that, when the railway vehicle circulates in a first longitudinal direction, the first abutment surface comes into contact with the articulation device so that the displacement of the bogie causes displacement of the bodies in the first direction via the articulation device, and when the railway vehicle circulates in a second longitudinal direction opposite to the first direction, the second abutment surface comes into contact with the articulation device so that the displacement of the bogie causes displacement of the bodies in the second longitudinal direction via the articulation device;

the articulation device comprises a first articulation element attached to one of the bodies and a second articulation element attached to the other body, said first and second articulation elements being connected to each other so as to form an articulated connection between both bodies, the first articulation element extending facing the first abutment surface and the second articulation element extending facing the second abutment surface;

the bogie comprises two motors each positioned on one of the sides of the chassis on either side of the space along a transverse direction substantially perpendicular to the longitudinal direction, each motor being connected to two of the wheels of the bogie through transmission means; and the bogie comprises four braking clamps, each braking clamp being positioned around a portion of one of the wheels of the bogie in order to allow braking of the bogie when said clamps are actuated, the clamps extending two by two one facing the other along the longitudinal direction so that each clamp extends between the wheels of one of the pairs of wheels, each clamp being positioned on the inner side of the wheel around which said clamp is positioned.

BRIEF DESCRIPTION OF THE DRAWINGS

Other aspects and advantages of the invention will become apparent upon reading the description which follows, given as an example and made with reference to the appended drawings, wherein.

DETAILED DESCRIPTION OF THE PREFERRED EMBODIMENTS

Figure 1:
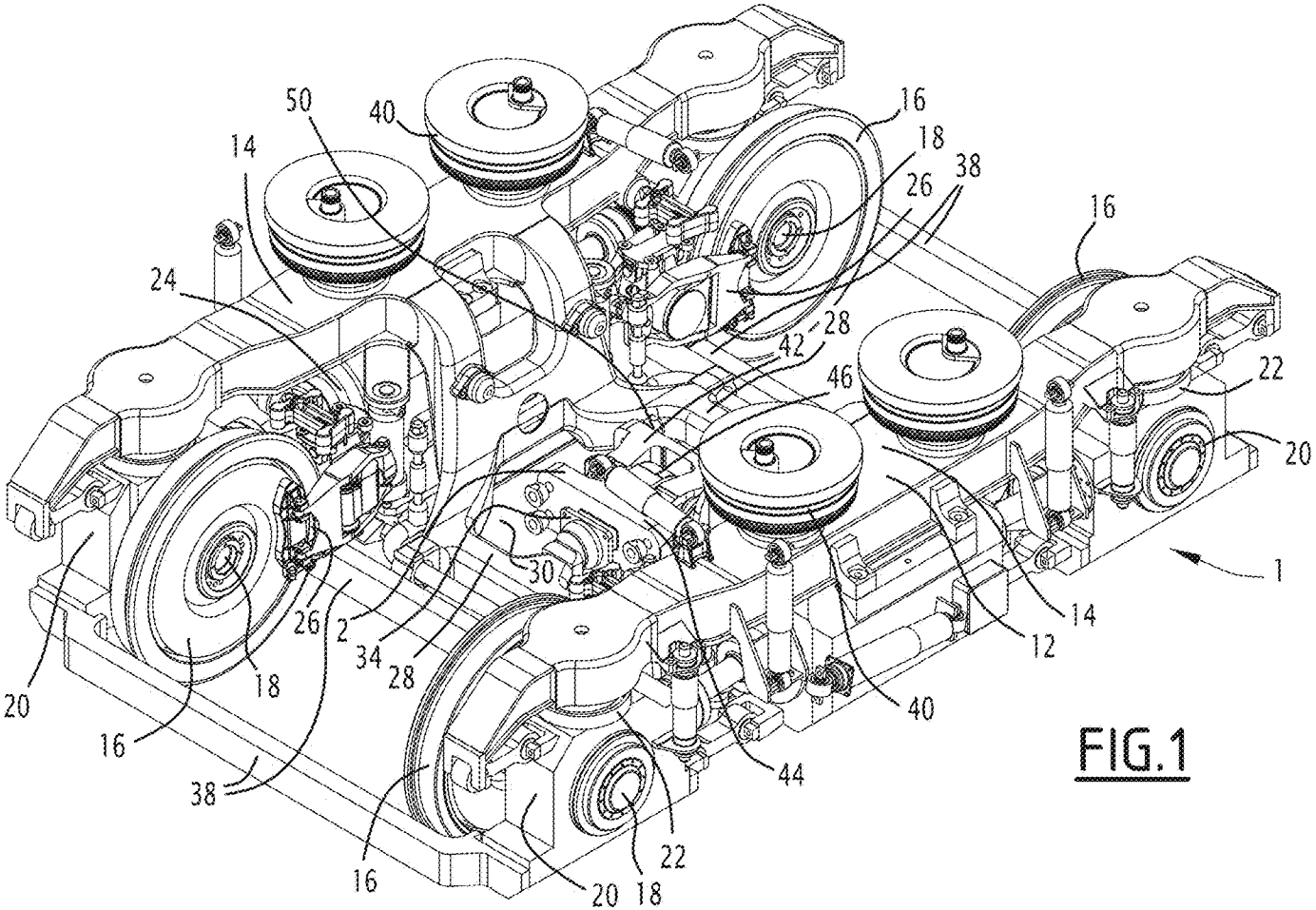
FIG. 1 is a schematic perspective illustration of a bogie and of an articulation device of a railway vehicle according to the invention.

In the description, the terms of "on", "under", "above", "below" are defined with respect to an elevational direction of a railway vehicle when it is positioned on rails, i.e. a substantially vertical direction when the train circulates. The longitudinal direction is defined by the circulation direction of the railway vehicle and the transverse direction is the direction substantially perpendicular to the longitudinal direction and to the elevational direction of the railway vehicle.

With reference to FIGS. 1 to 4, a bogie 1 and an articulation device 2 of a railway vehicle 4 comprising at least two adjacent carriages 6 are described with view to forming a railway vehicle with two levels, the interconnection of which allow circulation on both levels, as this will be described subsequently.

The bogie 1 extend under and between two adjacent carriages 6 and is laid out for supporting the bodies 8 of these carriages. More particularly, the bogie 1 is laid out for supporting the ends 10, facing each other, of the bodies 8 of the adjacent carriages 6.

According to the exemplary embodiment illustrated in FIG. 1, the bogie 1 comprises a chassis 12 comprising two longitudinal members 14 extending substantially along the longitudinal direction for circulation of the railway vehicle and spaced from each other along the transverse direction substantially perpendicular to the longitudinal direction and to the elevational direction of the railway vehicle.

Two wheels 16 are mounted on each member 14, at each of the longitudinal end portions of the latter, so that a pair of wheels 16 extends on each side of the chassis 12. More particularly, each wheel 16 comprises an individual shaft 18 rotatably mounted around a transverse axis on an axle body 20. By individual shaft, is meant that each wheel 16 is rotationally movable with respect to the chassis independent of the other wheels, unlike a traditional bogie in which an axle generally connects the wheels two by two and simultaneously drives two wheels into rotation. Each extreme portion of a longitudinal member 14 rests on an axle body 20 via primary suspension 22 allowing vertical displacement of the chassis 1 with respect to the wheels 16. The wheels are mounted so as to extend, along the transverse direction, inside the gauging device defined by the contour of the chassis 12, the axle bodies 20 being positioned on the outer side of the wheels 16.

In the case of a motor-driven bogie 1, each member 14 further bears at least one motor 24 laid out for driving into rotation both wheels 16 borne by the member. The motor is thus connected to the axle body 20 of each wheel 16 through transmission means. These transmission means are for example of the same type as those described in document EP-1 270 359 and will not be described in more detail here. Each motor 24 is borne by its member 14 between both wheels 16 borne by said member 14.

The bogie 1 further comprises a braking device comprising four brake clamps 26, each positioned, around a portion of one of the wheels 16 so as to brake the wheels 16 in a known way when the braking device is actuated. The brake clamps 26 are each positioned on the inner side of the wheels 16 along the longitudinal direction, i.e. they extend towards the centre of the bogie 1 along the longitudinal direction and not outwards, as this is usually the case. Thus, the brake clamps 26 extend two by two one facing the other along the circulation direction so that each clamp 26 extends between the wheels of one of the pairs of wheels along the longitudinal direction.

The side members 14 are connected to each other through at least one crosspiece 28 extending along the transverse direction between two members 14. According to the embodiment illustrated in the figures, the members 14 are connected with two crossmembers 28 spaced apart from each other along the longitudinal direction. The crossmembers 28 comprise at least one central portion extending in a plane lowered between the longitudinal members, i.e. in a plane extending under the plane defined by the axes of the wheels 16.

A space 30 is delimited, in the plane of the crossmembers 28, by two crossmembers 28 along the longitudinal direction and by the longitudinal members 14 along the transverse direction. The space 30 for example extends between both motors 24 along the transverse direction.

The bogie 1 further comprises a first abutment surface 32 and a second abutment surface 34 extending into the space 30, on either side of the latter along the longitudinal direction. The abutment surfaces 32 and 34 thus extend facing each other on either side of the space 30 along the longitudinal direction, for example substantially at the centre of the bogie 1 along the transverse direction. The first and second abutment surfaces 32 and 34 are for example each borne by one of the crossmembers 28 delimiting the space 30, as this is more particularly visible in FIG. 4. The first and second abutment surfaces 32 and 34 are for example formed by shoes each extending into a plane defined by the transverse direction and by the elevational direction. Depending on the embodiment illustrated in the figures, an absorption element, for example in rubber, 36 is positioned between each abutment surfaces 32, 34 and the crosspiece 28 which bears this abutment surface 32, 34.

According to the embodiment illustrated in the figures, the bogie 1 further comprises secondary crossmembers 38 connecting together the axle bodies 20, these secondary crossmembers 38 being positioned on either side of each wheel 16, at a height substantially identical with that of the crossmembers 28, i.e. a height lowered under the plane defined by the shafts 18 of the wheels 16. These secondary crossmembers 38 ensure the maintaining of the distance and of the parallelism between the wheels 16.

Figure 2:
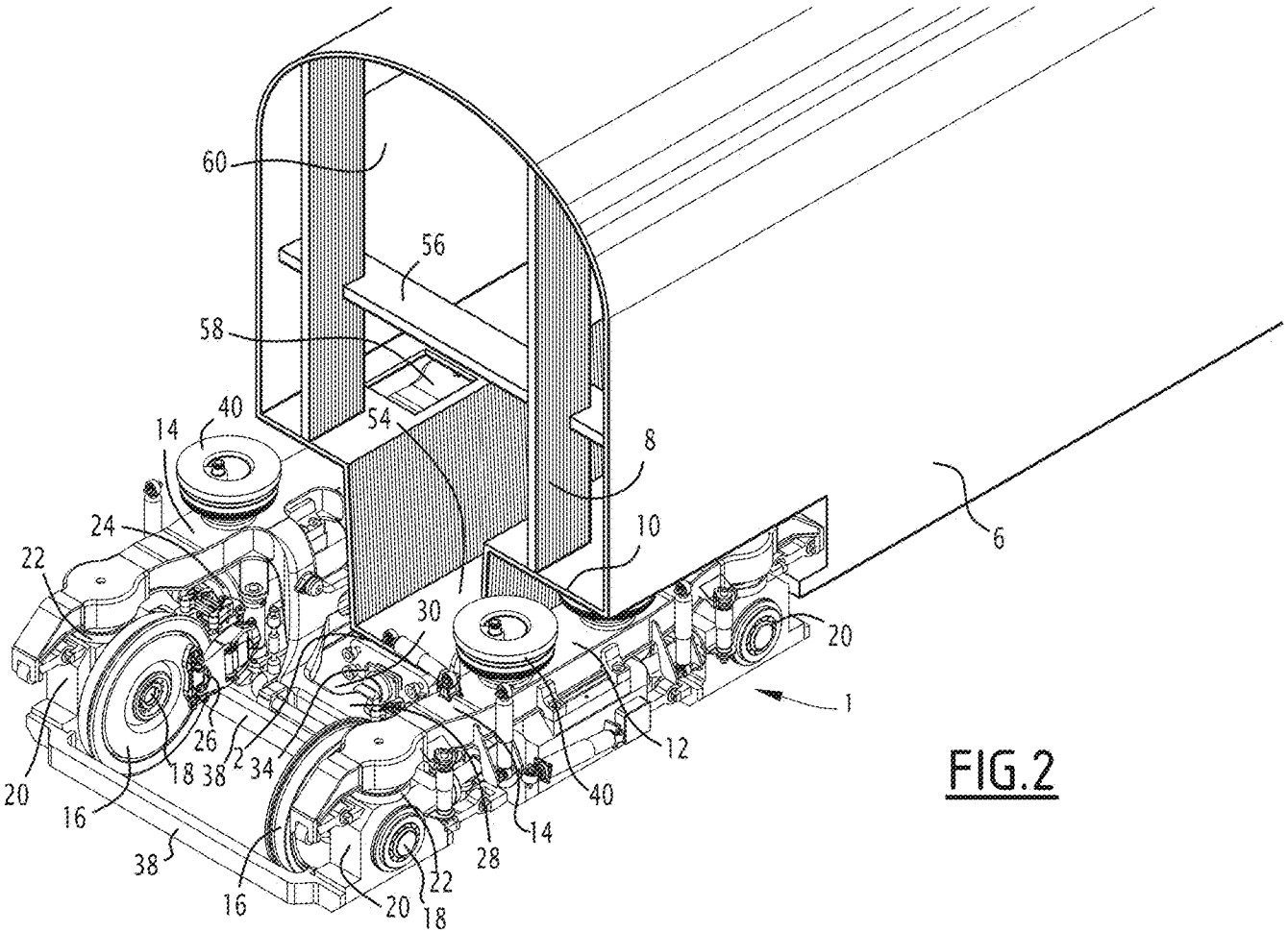
FIG. 2 is a schematic perspective illustration of the bogie of FIG. 1 supporting a carriage body of a railway vehicle according to the invention.
Figure 3:
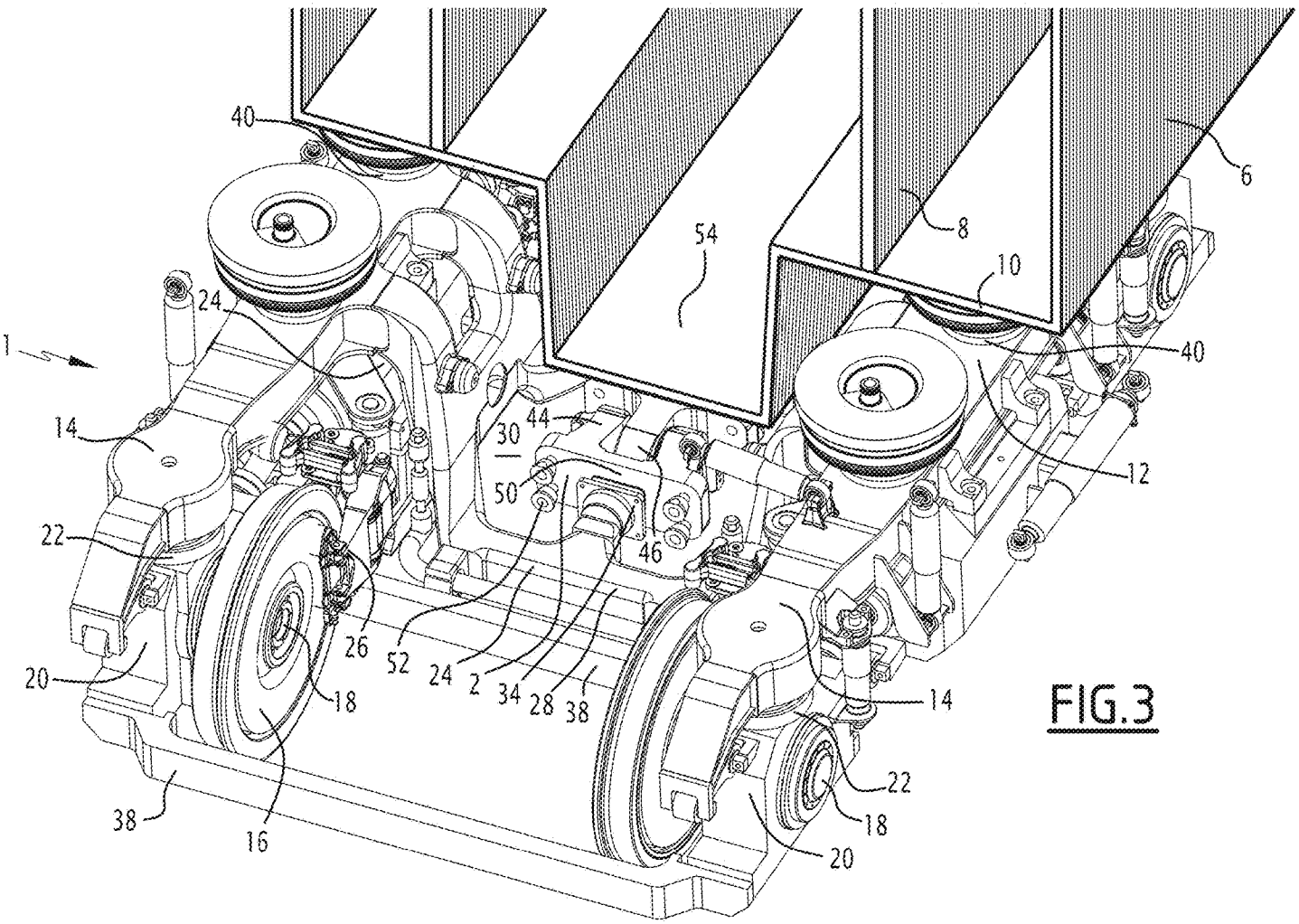
FIG. 3 is an enlarged view of a portion of FIG. 2.

The bogie above gives the possibility of having a significant available space between the longitudinal members 14 above the crossmembers 28, as this is visible in FIGS. 1 to 3. Indeed, the bogie 1 does not comprise any elements positioned between both members 14 above the plane defined by the crossmembers 28. This space will allow the passing of a lowered interconnection floor, as this will be described subsequently. It is understood that another bogie structure may be contemplated, outside the space 30 and the abutment surfaces 32 and 34, as long as a space is left free for the passing of the interconnection. As an example, the bogie may be a driven bogie, i.e. without a motor, or all wheels of the bogie are not necessarily driven into rotation by a motor.

The facing ends 10 of the bodies 8 of both adjacent carriages 6 are received by secondary suspensions 40 provided on the longitudinal members 14, allowing vertical displacement of the bodies 8 with respect to the bogie 1.

Both bodies 8 are articulationed with each other by the articulation device 2 attached to both bodies so as to form an articulated connection between both bodies giving the possibility of absorbing the displacements between both bodies 8. More particularly, the articulation device 2 for example comprises a first articulation element 42 attached to the end 10 of one of the bodies 8, and a second articulation element 44 attached to the end 10 of the other body 8, the first and second articulation elements 42 and 44 being connected to each other so as to form an articulated connection between both bodies. The connection between both articulation elements 42 and 44 for example forms a ball articulation 46 allowing displacement in all directions between the bodies.

Figure 4:
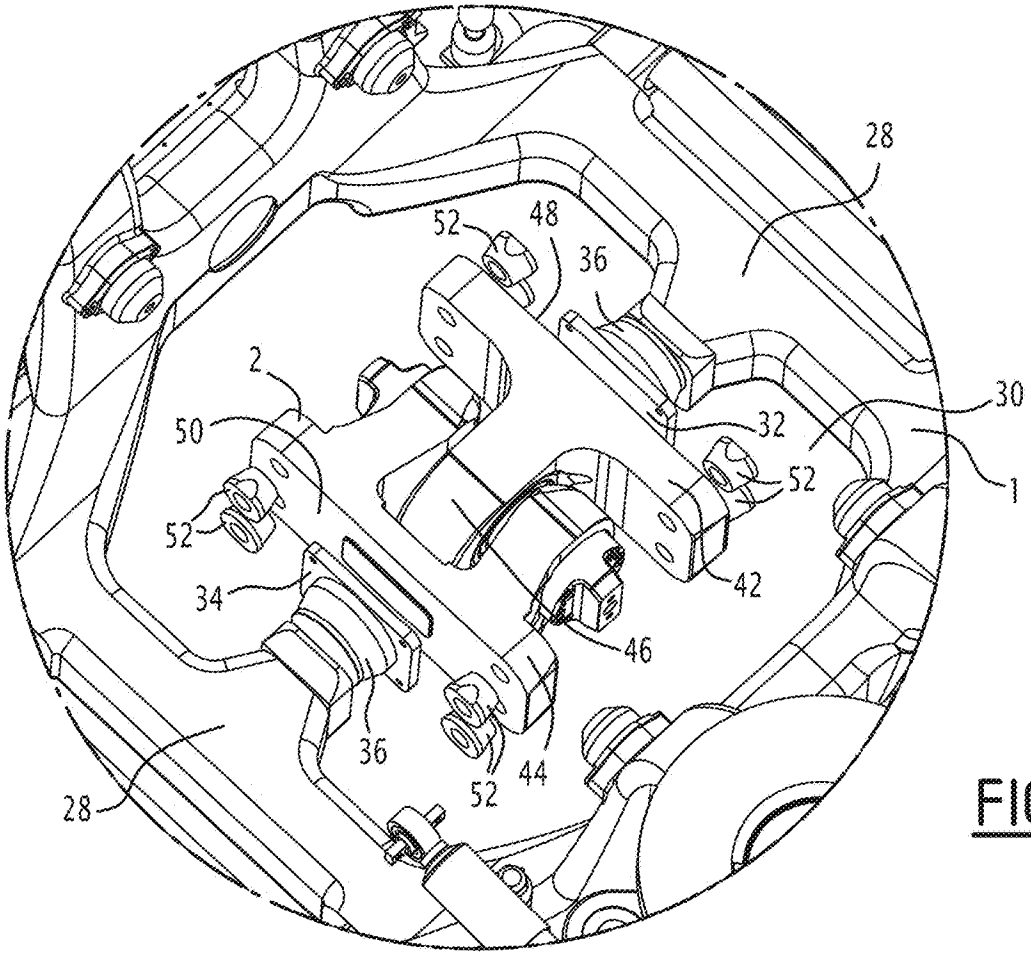
FIG. 4 is a schematic perspective illustration of the articulation device and of the abutment surfaces of FIG. 1.

The articulation elements 42 and 44 are attached to the bodies 8 so that the articulation device 2 extends in the space 30 between the abutment surfaces 32 and 34, as more particularly visible in FIG. 4. The articulation device 2 and the space 30 are dimensioned in such a way that a displacement exists along the longitudinal direction. In other words, the distance separating the first abutment surface 32 from the second abutment surface 34 along the longitudinal direction is greater than the dimension of the articulation device 2 along the longitudinal direction.

The first articulation element 42 comprises a counter-abutment surface 48 extending facing the first abutment surface 32 and the second articulation element 44 comprises a counter-abutment surface 50 extending facing the second abutment surface 34. The counter-abutment surfaces further bear means 52 for attachment to the body 8.

Thus, when the railway vehicle is mounted and when it circulates along a first longitudinal circulation direction from the first abutment surface 32 to the second abutment surface 34, the bogie 1 moves until the first abutment surface 32 comes into contact with the counter-abutment surface 48 of the first articulation element 42, so that the bogie 1 causes displacement of the carriages 6 via the articulation device 2 along this first longitudinal direction. Similarly, when the railway vehicle moves along a second longitudinal circulation direction, opposite to the first longitudinal direction, from the second abutment surface 34 to the first abutment surface, the bogie 1 moves until the second abutment surface 34 comes into contact with the counter-abutment surface 50 of the second articulation element 44, so that the bogie 1 causes displacement of the carriages 6 via the articulation device 2 along this second longitudinal direction.

As the articulation device extends into the space 30, this articulation device does not either occupy the free space between the longitudinal members 14 above the crossmembers 28. Thus, this space is left free for the passing of a low interconnection floor, as this will now be described.

Figure 5:
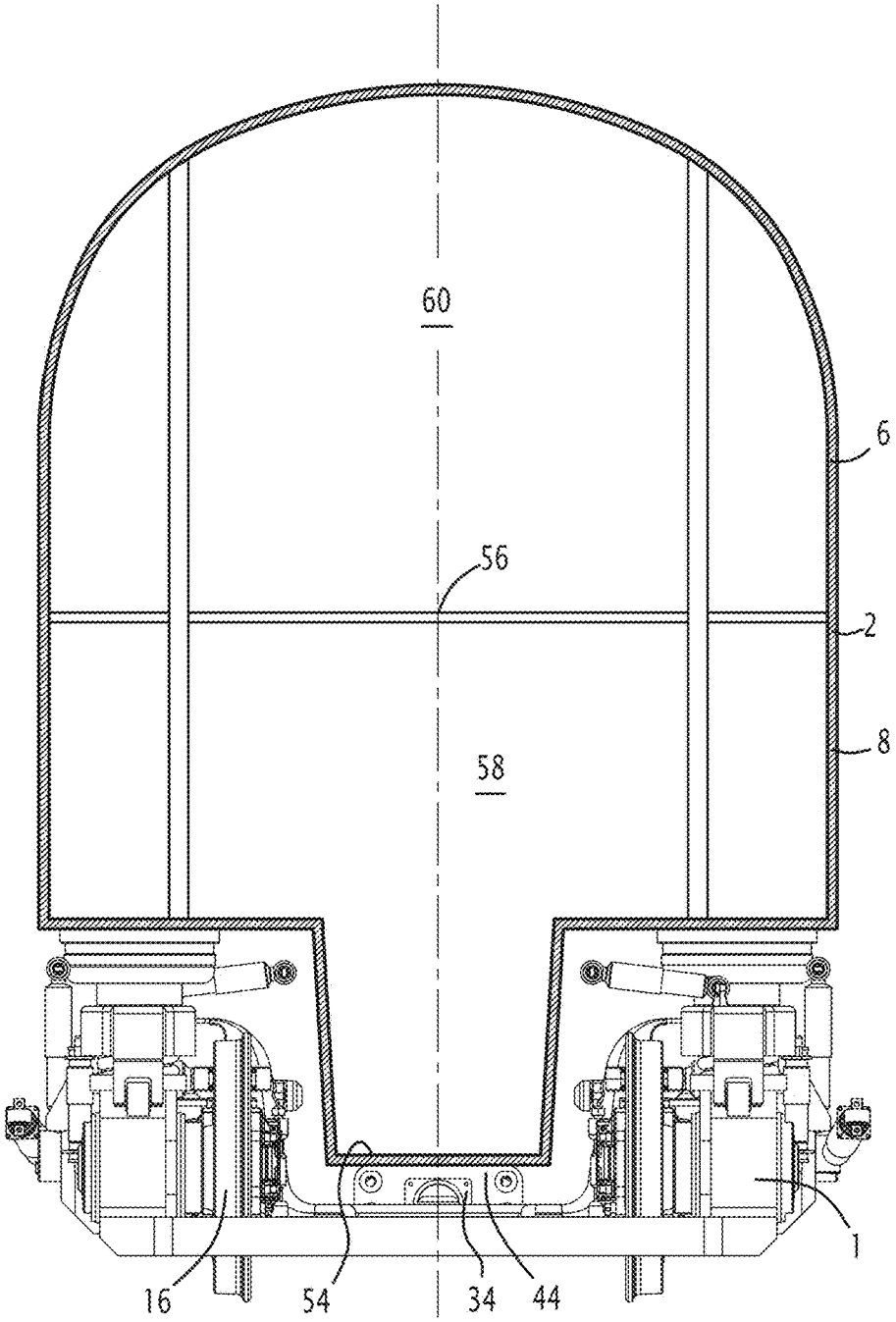
FIG. 5 is a schematic sectional illustration of the interconnection provided between both adjacent carriages of the railway vehicle according to the invention.

Each carriage 6 is a two-level carriage, as illustrated in FIG. 5. Thus, each carriage 6 comprises a lower floor 54 and an upper floor 56, positioned above each other so as to define a lower level 58 and an upper level 60. The lower floor 54 and the upper floor 56 are for example substantially planar and horizontal so that the carriages may be walked through without any difficulty. Further, the lower 54 and upper 56 floors of a carriage extend at the same level as the lower 54 and upper 56 floors of the other level, i.e. the lower 54 and upper 56 floors of all the carriages extend at the same height, the height of the upper floors 56 being greater than that of the lower floors 54. As an example, the lower floor 54 extends at a height substantially comprised between 530 and 550 mm and the upper floor 56 extends at a height substantially comprised between 2 380 and 2 400 mm. The heights given above depend on the gauging device into which the vehicle has to be included.

The carriages 6 are connected to each other through an interconnection passage 62 extending substantially upright angles to the articulation device 2 and allowing the passing from one carriage to the other to the users of the railway vehicle. For this purpose, the interconnection passage 62 comprises a lower floor, connecting the lower floors 54 of the carriages 6 and extending at the same height as these floors, and an upper floor, connecting the upper floors 56 of the carriages 6 and extending at the same height as these floors. Thus, the users of the railway vehicle do not need to change level for passing from one carriage to the other, as this is usually the case in two-storey railway vehicles. Further, the passing from one carriage to the other through the lower level may be accomplished without crossing any step or ramp since the lower floors all extend at the same height. The circulation in the railway vehicle is thereby facilitated, in particular for persons with reduced mobility.

The arrangement of the lower floor of the interconnection passage 62 at the same height as that of the lower floors 54 of the carriages is made possible by the layout of the bogie 1, which has a large free space between the longitudinal members 14. Thus, the lower floor of the interconnection passage 62 may extend in a plane coinciding with one of the planes of the bogie 1 and more particularly with a neighboring plane of the plane defined by the crossmembers 28, as illustrated in FIG. 4.

The railway vehicle described above may be applied, as illustrated in FIGS. 6 and 7, with more than two carriages 6 and with an optimized capability of receiving travelers.

The interconnection passage described above may be used in two-level railway vehicles and for which the carriages are articulated with each other with an articulation device different from the one described above. For example, the carriages may be articulated with each other in a conventional way and the driving of which would be directly accomplished by the bogies without requiring an abutment of the articulation device on corresponding abutment surfaces.

Figure 6:
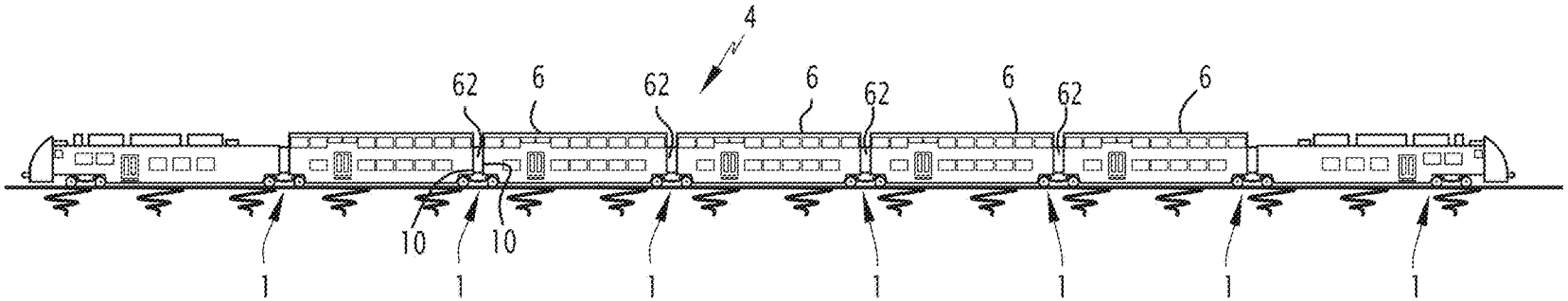
FIG. 6 is a schematic side illustration of a railway vehicle according to the invention.
Figure 7:
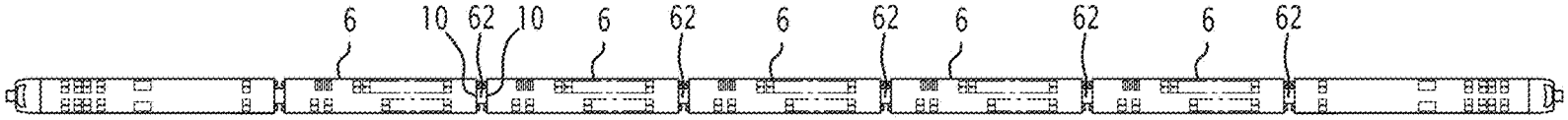
FIG. 7 is a schematic sectional illustration of the railway vehicle of FIG. 6.

According to an embodiment illustrated in FIGS. 6 and 7, the railway vehicle thus comprises five two-level carriages 6 and two end carriages 64, each comprising one level and a control station. The carriages with two levels 6 are connected to each other through an interconnection passage 62 as described above. Such a railway vehicle is able to receive 600 passengers. Further, the bogie is adapted for trains circulating at high speeds ranging up to 200 km/h, or even beyond, while having a structure giving the possibility of receiving a lowered lower floor as described earlier.

It is understood that the structure of the articulation device 2 may be different from the one described above, as long as this articulation device is able to come into contact with the abutment surfaces of the bogie 1 so that the bogie causes displacement of the carriages of the vehicle.

The invention claimed is:

1. A railway vehicle comprising:

at least two adjacent carriages (6), each at least two adjacent carriages (6) comprising a carriage body (8), each carriage (6) comprising a lower floor (54) and an upper floor (56), positioned above each other so as to define a lower level (58) and an upper level (60), said carriage bodies (8) being supported by a common bogie (1) and being articulated with each other through an articulation device (2) attached to both of the two adjacent carriage bodies (8) so as to form an articulated connection between both of the two adjacent carriage bodies (6), wherein the two adjacent carriages (6) are connected with each other through an interconnection passage (62), said interconnection passage (62) extending substantially upright angles to the articulation device (2) and comprising a lower floor connecting the lower floors (54) of both of the two adjacent carriages (6) and an upper floor connecting the upper floors (56) of both of the two adjacent carriages.

2. The railway vehicle according to claim 1, wherein the lower floors (54) of the carriages (6) and of the interconnection passage (62) extend substantially at the same height and the upper floors (56) of the carriages (6) and of the interconnection passage (62) extend substantially at the same height, greater than the height of the lower floors (54).

3. The railway vehicle according to claim 2, wherein the plane of the lower floors (54) coincides with a plane crossing the bogie (1).

4. The railway vehicle according to claim 1, wherein the lower floor (54) of the carriages (6) extend at a height substantially comprised between 530 and 550 mm and the upper floor (56) of the carriages (6) extend at a height substantially comprised between 2 380 and 2 400 mm.

5. The railway vehicle according to claim 1, wherein the bogie (1) comprises a chassis (12) resting on four wheels (16), a pair of wheels (16) extending on each side of the chassis (12), said chassis (12) supporting at least one motor (24) positioned on one side of the chassis (12) and connected to at least one wheel (16) through transmission means, each wheel (16) including an individual wheel shaft (18).

6. The railway vehicle according to claim 5, wherein said chassis (12) of the bogie (1) comprises two longitudinal members (14) positioned outside the wheels (16) and connected together through crossmembers (28) having a lowered central portion extending below the plane defined by the axis of the wheels (16).

7. The railway vehicle according to claim 6, wherein the bogie is without any elements positioned between the longitudinal members (14) above a plane defined by the crossmembers (28), the bogie thereby defining a space left free for the passing of the lower floor of the interconnection passage.

8. The railway vehicle according to claim 5, wherein the articulation device (2) is received in a space (30) of the bogie (1), said space (30) being delimited along a longitudinal direction by a first abutment surface (32) and by a second abutment surface (34) extending on either side of said space (30), the articulation device (2) extending facing said first and second abutment surfaces (32, 34) so that, when the railway vehicle circulates in a first longitudinal direction, the first abutment surface (32) comes into contact with the articulation device (2) so that the displacement of the bogie (1) causes displacement of the bodies (8) in the first direction via the articulation device (2), and, when the railway vehicle circulates in a second longitudinal direction opposite to the first direction, the second abutment surface (34) comes into contact with the articulation device (2) so that the displacement of the bogie (1) causes displacement of the bodies (8) in a second longitudinal direction via the articulation device (2).

9. The railway vehicle according to claim 8, wherein the articulation device (2) comprises a first articulation element (42) attached to one of the bodies (8) and a second articulation element (44) attached to the other body (8), said first and second articulation elements (42, 44) being connected to each other so as to form an articulated connection between both bodies (8), the first articulation element (42) extending facing the first abutment surface (32) and the second articulation element (44) extending facing the second abutment surface (34).

10. The railway vehicle according to claim 8, wherein the bogie (1) comprises two motors (24) each positioned on one of the sides of the chassis (12) on either side of the space (30) along a transverse direction substantially perpendicular to the longitudinal direction, each motor (24) being connected to two of the wheels (16) of the bogie (1) through transmission means.

11. The railway vehicle according to claim 2, wherein the lower floor (54) of the carriages (6) extend at a height substantially comprised between 530 and 550 mm and the upper floor (56) of the carriages (6) extend at a height substantially comprised between 2 380 and 2 400 mm.

12. The railway vehicle according to claim 3, wherein the lower floor (54) of the carriages (6) extend at a height substantially comprised between 530 and 550 mm and the upper floor (56) of the carriages (6) extend at a height substantially comprised between 2 380 and 2 400 mm.

13. The railway vehicle according to claim 2, wherein the bogie (1) comprises a chassis (12) resting on four wheels (16), a pair of wheels (16) extending on each side of the chassis (12), said chassis (12) supporting at least one motor (24) positioned on one side of the chassis (12) and connected to at least one wheel (16) through transmission means, each wheel (16) including an individual wheel shaft (18).

14. The railway vehicle according to claim 3, wherein the bogie (1) comprises a chassis (12) resting on four wheels (16), a pair of wheels (16) extending on each side of the chassis (12), said chassis (12) supporting at least one motor (24) positioned on one side of the chassis (12) and connected to at least one wheel (16) through transmission means, each wheel (16) including an individual wheel shaft (18).

15. The railway vehicle according to claim 4, wherein the bogie (1) comprises a chassis (12) resting on four wheels (16), a pair of wheels (16) extending on each side of the chassis (12), said chassis (12) supporting at least one motor (24) positioned on one side of the chassis (12) and connected to at least one wheel (16) through transmission means, each wheel (16) including an individual wheel shaft (18).

16. The railway vehicle according to claim 1, wherein the articulation device (2) is received in a space (30) of the bogie (1), said space (30) being delimited along a longitudinal direction by a first abutment surface (32) and by a second abutment surface (34) extending on either side of said space (30), the articulation device (2) extending facing said first and second abutment surfaces (32, 34) so that, when the railway vehicle circulates in a first longitudinal direction, the first abutment surface (32) comes into contact with the articulation device (2) so that the displacement of the bogie (1) causes displacement of the bodies (8) in the first direction via the articulation device (2), and, when the railway vehicle circulates in a second longitudinal direction opposite to the first direction, the second abutment surface (34) comes into contact with the articulation device (2) so that the displacement of the bogie (1) causes displacement of the bodies (8) in a second longitudinal direction via the articulation device (2).

17. The railway vehicle according to claim 2, wherein the articulation device (2) is received in a space (30) of the bogie (1), said space (30) being delimited along a longitudinal direction by a first abutment surface (32) and by a second abutment surface (34) extending on either side of said space (30), the articulation device (2) extending facing said first and second abutment surfaces (32, 34) so that, when the railway vehicle circulates in a first longitudinal direction, the first abutment surface (32) comes into contact with the articulation device (2) so that the displacement of the bogie (1) causes displacement of the bodies (8) in the first direction via the articulation device (2), and, when the railway vehicle circulates in a second longitudinal direction opposite to the first direction, the second abutment surface (34) comes into contact with the articulation device (2) so that the displacement of the bogie (1) causes displacement of the bodies (8) in a second longitudinal direction via the articulation device (2).

18. The railway vehicle according to claim 3, wherein the articulation device (2) is received in a space (30) of the bogie (1), said space (30) being delimited along a longitudinal direction by a first abutment surface (32) and by a second abutment surface (34) extending on either side of said space (30), the articulation device (2) extending facing said first and second abutment surfaces (32, 34) so that, when the railway vehicle circulates in a first longitudinal direction, the first abutment surface (32) comes into contact with the articulation device (2) so that the displacement of the bogie (1) causes displacement of the bodies (8) in the first direction via the articulation device (2), and, when the railway vehicle circulates in a second longitudinal direction opposite to the first direction, the second abutment surface (34) comes into contact with the articulation device (2) so that the displacement of the bogie (1) causes displacement of the bodies (8) in a second longitudinal direction via the articulation device (2).

19. The railway vehicle according to claim 4, wherein the articulation device (2) is received in a space (30) of the bogie (1), said space (30) being delimited along a longitudinal direction by a first abutment surface (32) and by a second abutment surface (34) extending on either side of said space (30), the articulation device (2) extending facing said first and second abutment surfaces (32, 34) so that, when the railway vehicle circulates in a first longitudinal direction, the first abutment surface (32) comes into contact with the articulation device (2) so that the displacement of the bogie (1) causes displacement of the bodies (8) in the first direction via the articulation device (2), and, when the railway vehicle circulates in a second longitudinal direction opposite to the first direction, the second abutment surface (34) comes into contact with the articulation device (2) so that the displacement of the bogie (1) causes displacement of the bodies (8) in a second longitudinal direction via the articulation device (2).

20. The railway vehicle according to claim 6, wherein the articulation device (2) is received in a space (30) of the bogie (1), said space (30) being delimited along a longitudinal direction by a first abutment surface (32) and by a second abutment surface (34) extending on either side of said space (30), the articulation device (2) extending facing said first and second abutment surfaces (32, 34) so that, when the railway vehicle circulates in a first longitudinal direction, the first abutment surface (32) comes into contact with the articulation device (2) so that the displacement of the bogie (1) causes displacement of the bodies (8) in the first direction via the articulation device (2), and, when the railway vehicle circulates in a second longitudinal direction opposite to the first direction, the second abutment surface (34) comes into contact with the articulation device (2) so that the displacement of the bogie (1) causes displacement of the bodies (8) in a second longitudinal direction via the articulation device (2).

* * * * *